United States Patent [19]

Grable

[11] 4,220,939

[45] Sep. 2, 1980

[54] THERMAL RESPONSIVE ELECTRICAL SWITCHING DEVICE AND CALIBRATION METHOD THEREFOR

[75] Inventor: Jack W. Grable, Dayton, Ohio

[73] Assignee: Emerson Electric Co., St. Louis, Mo.

[21] Appl. No.: 11,214

[22] Filed: Feb. 12, 1979

[51] Int. Cl.[2] ..... H01H 61/08

[52] U.S. Cl. ..... 337/94; 337/368; 29/622

[58] Field of Search ..... 337/89, 94, 112, 113, 337/343, 347, 365, 368; 29/622, 623

[56] References Cited

U.S. PATENT DOCUMENTS

| | | | |
|---|---|---|---|
| 2,627,003 | 1/1953 | Porter | 337/94 X |
| 3,223,808 | 12/1965 | Wehl | 337/94 X |
| 3,230,607 | 1/1966 | Gelzer | 337/94 X |
| 3,577,111 | 5/1971 | Nardulli | 337/89 |
| 4,047,141 | 9/1977 | Holden | 337/89 |

*Primary Examiner*—George Harris

*Attorney, Agent, or Firm*—Biebel, French & Nauman

[57] ABSTRACT

A thermal responsive electrical switching device provides an electrical connection between first and second electrical connectors when the temperature of the switching device is less than a first predetermined temperature level and terminates the electrical connection when the temperature of the device exceeds the first predetermined temperature level. The electrical connection is not re-established until after the temperature of the switching device has dropped below a second predetermined temperature level which is less than the first predetermined temperature level. The switching device includes an actuator means mounted on a bimetal blade which causes a snap contact blade to be snapped into first and second snap positions as a result of movement of the bimetal blade. The actuator means includes first and second actuators which are embedded in a curable material. The switching device is calibrated adjusting the position of a movable contact and a snap contact and heating the switching device to the first predetermined temperature. The curable material is thereafter cured to fix the positions of the first and second actuators with respect to the bimetal blade.

7 Claims, 7 Drawing Figures

THERMAL RESPONSIVE ELECTRICAL SWITCHING DEVICE AND CALIBRATION METHOD THEREFOR

BACKGROUND OF THE INVENTION

The present invention relates to thermal responsive electrical switching devices and, more particularly, to a switching device, and calibration method therefor, in which an electrical connection is provided between first and second electrical connectors until the temperature of the device is raised to a first predetermined temperature level. Thereafter, the electrical connection will not be re-established until the temperature of the device is lowered below a second predetermined temperature level which is less than the first predetermined temperature level. This dual temperature level threshold arrangement prevents extended rapid switching of the device which would otherwise occur if only a single threshold temperature level were utilized for terminating and re-establishing the electrical switch connection.

Numerous switches of this type, having either adjustable or fixed predetermined threshold temperature levels, are known in the prior art. All such switches, however, have required that the relative position of the switch elements be set precisely by a technician in order that switch actuation and resetting occur at the desired threshold temperature levels. As will be appreciated, tedious, time consuming manual adjustment of switch elements during the calibration operation results in relatively high production costs and, further, heightens the chance of miscalibration of the switches.

U.S. Pat. No. 3,230,607, issued Jan. 25, 1966, to Gelzer, discloses a thermostatic creep action switch having a bimetal contact blade which gradually deflects to open the switch contacts at a predetermined threshold temperature. One of the contacts is mounted on the bimetal contact blade. Switch actuation, both in terminating and re-establishing the electrical switch connection, occurs at a single threshold temperature. The Gelzer switch includes a quantity of epoxy cement which is hardened to fix the relative position of the switch elements after the elements are positioned by flexure of the bimetal blade. Prior to hardening of the epoxy cement, the switch is heated to a specified temperature causing the bimetal contact blade to deflect and shift the relative position of switch elements. The epoxy cement is then cured, resulting in calibration of the switch without adjustment of the positions of switch elements by a technician.

In U.S. patent application, Ser. No. 001,215, filed on even date herewith and assigned to the assignee of the present invention, a creep action switching device is disclosed in which a bimetal element not connected electrically in the switching circuit, gradually deflects as the temperature of the device is raised and moves a movable contact blade out of electrical contact with a stationary contact blade. An actuator structure between the bimetal element and the movable contact blade includes a curable material, such as a resin. The resin is cured during calibration after the switching device is heated and the bimetal blade is deflected to a desired position, thereby permitting the switching device to be calibrated without the requirement of manual adjustment by a technician. Termination and re-establishment of the electrical switch connection occurs at the same temperature. A second embodiment in the above referenced application includes two serially connected pairs of contacts, with one of the pairs of contacts being opened when the switching device is above a first predetermined temperature and the second of the pair of contacts being opened when the switching device is below a second predetermined threshold temperature.

Accordingly, it is seen that there is a need for an electrical switching device which terminates an electrical connection when heated to a first predetermined temperature level and does not re-establish the electrical connection until the temperature of the switching device drops below a second, lower predetermined temperature level, and which switching device is simple in construction and may be calibrated with a minimum of manual adjustment.

SUMMARY OF THE INVENTION

A thermal responsive electrical switching device for providing an electrical connection between first and second electrical connectors when the temperature of said device is less than a first predetermined temperature level and for terminating electrical connection when the temperature of the device exceeds the first predetermined temperature level, electrical connection between the first and second electrical connectors thereafter being re-established when the temperature of said device is less than a second lower predetermined temperature level, includes a non-conductive mounting means. A movable contact means is mounted on the non-conductive mounting means and is electrically connected to the first electrical connector.

A bistable snap contact means is mounted on the non-conductive mounting means and is electrically connected to the second electrical connector. The bistable snap contact means has a first snap position in which it is biased into electrical contact with the movable contact means to provide electrical connection between the first and second electrical connectors. The bistable snap contact means has a second snap position in which it is biased out of electrical contact with the movable contact means to terminate the electrical connection between the first and second electrical connectors.

A thermal responsive bimetal means is mounted on the non-conductive mounting means on the side of the movable contact means opposite the bistable snap contact means. The thermal responsive bimetal means deflects toward the movable contact means in response to an increase in the temperature of the device. An actuator means is mounted on the bimetal means and defines a cavity containing a quantity of cured material. The actuator means includes a first actuator for contacting the movable contact means as the bimetal means is deflected toward the movable contact means to cause the bistable contact means to snap into its second snap position. The acutator means further includes a second actuator for contacting the bistable contact means as the bimetal means is deflected away from the movable contact means to cause the bistable contact means to snap into its first snap position. Both the first actuator and the second actuator are embedded in the cured material.

A method of switch calibration is provided in which the bistable snap contact means is placed in a first snap position in which it is biased into electrical contact with the movable contact means. The movable contact means is deflected toward the bistable snap contact means sufficiently to cause the bistable snap contact means to snap into a second snap position in which it is biased out of the electrical contact with the movable contact means. The bistable snap contact means is then moved toward the movable contact means until a spacing between the movable contact means and the bistable snap contact means is obtained which is related to the temperature differential between the first and second predetermined temperature levels. The second actuator is maintained in contact with the bistable snap contact means, the first actuator is maintained in contact with the movable contact means and both of the first and second actuators extend into the curable material. The switching device is then heated to the first predetermined temperature level, causing the bimetal means to deflect toward the movable contact means. Thereafter, the curable material is cured such that the relative positions of the first and second actuators and the thermal responsive bimetal means are fixed.

Accordingly, it is an object of the present invention to provide a thermal responsive switching device and a calibration method therefor in which a minimum of manual adjustment of the switch elements is required for switch calibration; to provide such a switching device in which the relative positions of switch elements are fixed by means of a cured material; to provide such a switching device in which a bistable snap contact means is actuated by a bimetal means through an intermediate actuator means; and to provide such a switching device in which the positioning of the actuator means is fixed by curing a curable material after the bimetal means is deflected to a desired position by heating the switching device to a predetermined temperature level.

DETAILED DESCRIPTION OF THE PREFERRED EMBODIMENTS

Figure 1A:
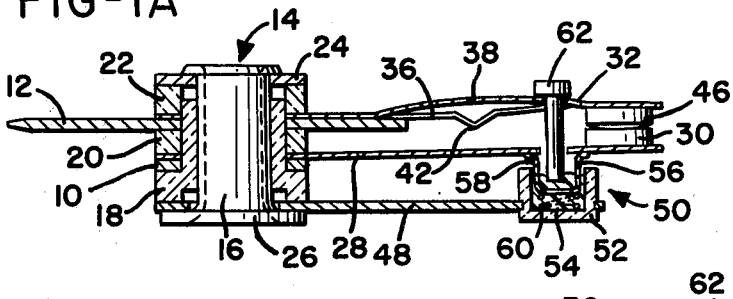
FIG. 1A is a sectional view of the thermal responsive electrical switching device of the present invention taken generally along line 1—1 in FIG. 2.
Figure 1B:
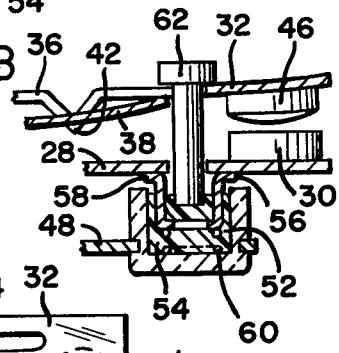
FIG. 1B is an enlarged fragmentary sectional view similar to FIG. 1A.
Figure 2:
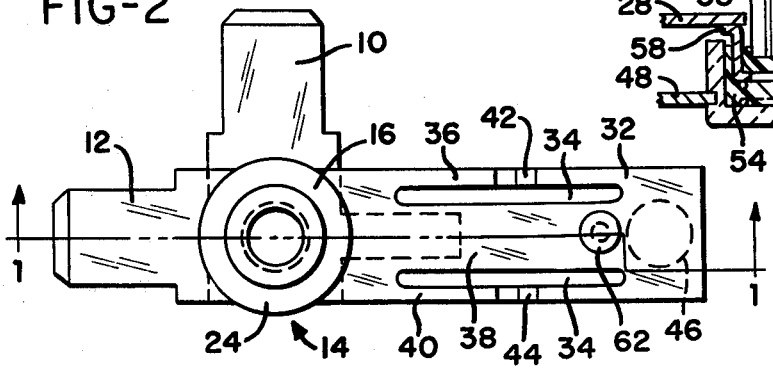
FIG. 2 is a plan view of the switching device.

Reference is now made to FIGS. 1 and 2, which illustrate the thermal responsive electrical switching device of the present invention. The switching device includes a first electrical connector 10 and a second electrical connector 12. When the temperature of the device is less than a first predetermined temperature level, electrical connection is provided between electrical connectors 10 and 12. When the temperature of the device exceeds the first predetermined temperature level, electrical connection between connectors 10 and 12 is terminated, with the electrical connection being re-established only after the temperature of the device is reduced below a second predetermined temperature level. The second predetermined temperature level is less than the first predetermined temperature level.

A non-conductive mounting means 14 is provided, including a mounting rivet 16, insulating sheath 18, non-conductive spacers 20 and 22, and mounting washer 24. The insulating sheath 18 and spacers 20 and 22 are held between the head 26 of mounting rivet 16 and the mounting washer 24.

A movable contact means includes a flexible contact blade 28 which is mounted between insulating sheath 18 and non-conductive spacer 20 on the mounting means 14 so as to be in electrical contact with the first electrical connector 10. Flexible contact blade 28 has an electrical contact 30 mounted thereon.

A bistable snap contact means includes a snap blade 32 which is mounted on the non-conductive mounting means 14 and held between spacers 20 and 22 such that it makes electrical contact with the second electrical connector 12. Snap blade 32 defines a pair of slots 34 which separate the blade 32 across its width into three regions 36, 38, and 40. Regions 36 and 40 define V-shaped crimps 42 and 44, respectively. The effect of crimps 42 and 44 is to shorten the length of the snap blade in the regions 36 and 40 and, as a result, the snap blade is forced to bow in the region 38, as illustrated in FIG. 1. When bowed upward, region 38 provides a snap spring force which urges electrical contact 46 downward into contact with contact 30. This first snap position of the bistable snap contact means is maintained until the snap blade 32 is moved upward by a sufficient distance such that the region 38 suddenly bows downward. When this occurs, region 38 provides an upward snap force, causing the blade to be urged toward a second snap position in which contact 46 is held out of electrical contact with the contact 30. Since the electrical connection between connectors 10 and 12 includes the blades 28 and 32 and contacts 30 and 46, it will be appreciated that moving the bistable snap contact means into its second snap position will result in termination of this electrical connection.

A thermal responsive bimetal means includes a bimetal blade 48 of standard design. Such blades typically include two layers of metal having dissimilar coefficients of thermal expansion, although in the drawings the two layers are not illustrated separately for purposes of clarity. When the temperature of such a bimetal blade is altered, the difference in expansion or contraction of the metals results in lateral deflection of the blade. The blade 48 is mounted on the non-conductive mounting means 14 between insulating sheath 18 and the head 26 of mounting rivet 16 such that it is out of electrical contact with the balance of the conductive elements of the switching device. The thermal responsive bimetal means is positioned on the side of the movable contact means which is opposite the bistable snap contact means.

The bimetal blade 48 deflects toward the movable contact means in response to an increase in the temperature of the switching device and away from the movable contact means in response to a decrease in the temperature of the switching device.

An actuator means 50, mounted on the blade 48, includes a non-conductive cup 52 defining a cavity therein which contains a quantity of cured material 54 which, for example, may comprise a heat cured resin material such as epoxy. A first actuator 56, generally cylindrical in shape, is provided for contacting the movable contact blade 28 as the bimetal means is deflected toward the blade 28. The first actuator 56 includes an actuator element 58, generally cylindrical in shape, embedded in cured material 54. The first actuator 56 further includes a spring means 60 which is completely surrounded by the cured material 54. Spring means 60 positions the actuator element 58 during the calibration operation before material 54 is cured, as described below. In the completed switching device, after calibration, the spring means 60 is held in place by the cured material 54 and, therefore, plays no part in the operation of the switching device. Actuator element 58 is shown as contacting the bottom of blade 28 but it should be understood that element 58 is not attached to blade 28 in any way.

The actuator means 50 further includes a second actuator 62 which contacts the snap blade 32 as the bimetal blade 48 is deflected away from contact blade 28 to cause the snap blade 32 to snap back into its first snap position. As illustrated in FIG. 1, the second actuator is also embedded in the cured material 54. The contact blade 28 and the snap blade 32 both define actuator openings therein through which the actuator 62 extends, such that it contacts the snap blade 32 on the opposite side thereof from the contact blade 28.

In operation, the thermal responsive electrical switching device of the present invention will maintain generally the position of elements shown in FIG. 1 until the bimetal blade 48 is heated to the first predetermined temperature level. The bimetal blade 48 will deflect blades 28 and 32 gradually upward in response to increases in temperature; however, electrical contact will be maintained between contacts 30 and 46. When the first predetermined temperature level is exceeded, the blade 48 pushes blades 28 and 32 upward by a distance sufficient to cause the snap blade 32 to snap into its second snap position illustrated in FIG. 1B. At this point, electrical contact between the contacts 30 and 36 is broken. The upper surface of the snap blade 32 in this position contacts the second actuator 62.

Contacts 30 and 46 thereafter remain out of contact until the temperature of the switching device is reduced below a second predetermined temperature level. Reductions in temperature level cause the blade 32 to be deflected downward by the bimetal blade 48 acting through second actuator 62. When the temperature of the device drops below the second predetermined temperature level, the bimetal blade 48 has deflected downward away from the flexible contact blade 28 by a sufficient distance such that the actuator 62 causes the snap blade 32 to snap into its first snap position, re-establishing electrical contact between contacts 30 and 46.

Reference is now made to FIGS. 3–6 which illustrate the manner in which the switching device is calibrated. The switching device is positioned in an oven, the bottom wall 64 and top wall 66 of which are shown as fragments. Threaded calibrating bolts 68 and 70 extend through walls 64 and 66, respectively, and are utilized in the calibration method as described below.

Figure 4:
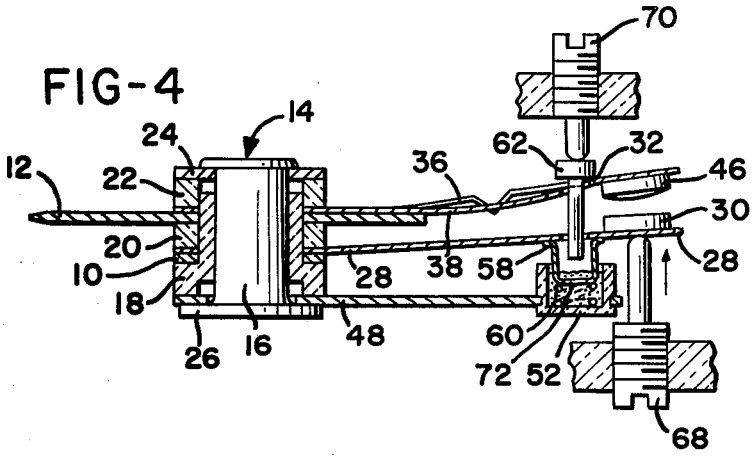

A quantity of uncured material 72 is placed in the insulating cup 52. The calibrating bolt 68 is then raised into contact with the flexible blade 28, as shown in FIG. 4. As the blade 28 is raised, the cylindrical actuator element 58 will be maintained in contact with the bottom surface thereof by spring means 60 which urges the actuator element 58 upward. Flexible blade 28 is raised upward until the snap blade 32 snaps upward toward its second snap position. Calibrating bolt 70, contacting the second actuator 62, is then lowered, moving the snap blade 32 downward to a position where a gap of dimension d is provided between contacts 30 and 46. The distance d is selected to correspond to the temperature differential between the first predetermined temperature level and the second predetermined temperature level. The larger the temperature differential desired, the greater will be the gap distance set in this operation.

Figure 6:
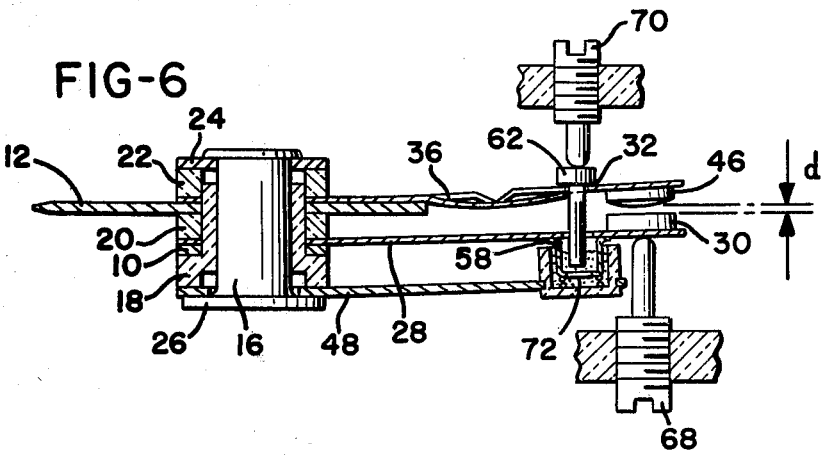
Figure 5:
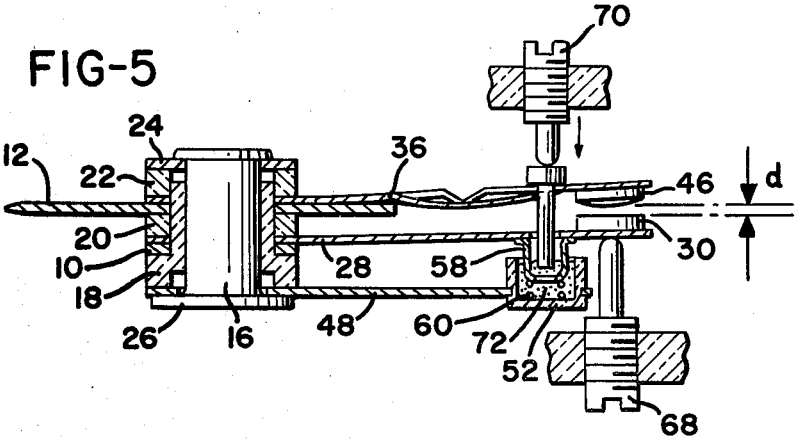

With the gap being set as illustrated in FIG. 5, the oven is heated until the switching device is heated to the first predetermined temperature level. As shown in FIG. 6, the bimetal blade 48 is deflected upward while the cylindrical actuator element 58 continues to be held against the lower surface of the flexible blade 28 by the spring means 60. The switching device is the maintained at the first predetermined temperature level until the curable material 72 is cured, fixing the relative positions of the actuator means 50 and the bimetal blade 48. The switching device is then properly calibrated for the desired switch actuation at the first and second predetermined temperature levels.

Figure 3:
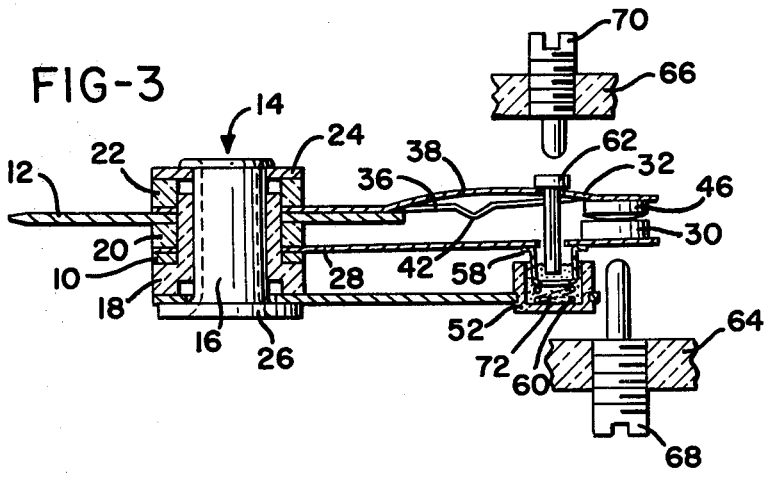
FIGS. 3–6 are sectional views of the switching device, similar to FIG. 1, illustrating the method by which the switching device is calibrated.

It will be appreciated that various modifications within the scope of the invention may be made to the switch and calibration method disclosed above. Curable material, other than heat curable resins, may be utilized in the actuator means for instance. The calibration method disclosed above in conjunction with FIGS. 3–6 may be modified in a manner which provides for more convenient calibration by performing the steps illustrated in FIGS. 3–5 prior to the insertion of the switching device into the oven. In such a calibration method, the switching device is mounted on a fixture which includes support elements for positioning calibrating bolts similar to bolts 68 and 70. These calibrating bolts are then adjusted as illustrated in FIGS. 3–5 and, subsequently, the fixture with the switching device mounted thereon is inserted into an oven in which heating of the switching device to the first predetermined temperature level occurs. The switching device is thereafter maintained at the first predetermined temperature level until the curable material is cured, fixing the relative positions of the actuator means and the bimetal blade.

While the method herein described, and the form of apparatus for carrying this method into effect, constitute preferred embodiments of the invention, it is to be understood that the invention is not limited to this precise method and form of apparatus, and that changes may be made in either without departing from the scope of the invention.

What is claimed is:

1. A thermal responsive electrical switching device for providing an electrical connection between first and second electrical connectors when the temperature of said device is less than a first predetermined temperature level and for terminating said electrical connection when the temperature of said device exceeds said first predetermined temperature level, said switching device thereafter re-establishing electrical connection between said first and second electrical connectors when the temperature of said device is less than a second predetermined temperature level, said second predetermined temperature level being less than said first predetermined temperature level, comprising:

non-conductive mounting means, movable contact means, mounted on said non-conductive mounting means, and electrically connected to said first electrical connector, bistable snap contact means, mounted on said non-conductive mounting means, and electrically connected to said second electrical connector, said bistable snap contact means having a first snap position in which it is biased into electrical contact with said movable contact means to provide said electrical connection between said first and second electrical connectors and a second snap position in which it is biased out of electrical contact with said movable contact means to terminate said electrical connection between said first and second electrical connectors, thermal responsive bimetal means, mounted on said non-conductive mounting means on the side of said movable contact means opposite said bistable snap contact means, for deflecting toward said movable contact means in response to an increase in the temperature of said device, and actuator means, mounted on said bimetal means, including a first actuator for contacting said movable contact means as said bimetal means is deflected toward said movable contact means to cause said bistable contact means to snap into said second snap position, and a second actuator for contacting said bistable contact means as said bimetal means is deflected away from said movable contact means to cause said bistable contact means to snap into said first snap position.

2. The thermal responsive electrical switching device of claim 1 in which said actuator means defines a cavity containing a quantity of cured material and in which said first and second actuators are embedded in said cured material.

3. The thermal responsive electrical switching device of claim 2 in which said first actuator comprises an actuator element embedded in said cured material and spring means in contact with said actuator element and completely surrounded by said curable material.

4. The thermal responsive electrical switching device of claim 2 in which said cured material is a heat curable resin.

5. The thermal responsive electrical switching device of claim 1 in which said movable contact means and said bistable snap contact means each define an actuator opening and in which said second actuator extends through said actuator openings in said movable contact means and said bistable snap contact means to contact said bistable snap contact means on the opposite side thereof from said movable contact means.

6. A method of calibrating a thermal responsive electrical switching device which provides an electrical connection between first and second electrical connectors when the temperature of the device is less than a first predetermined temperature level and which terminates the electrical connection when the temperature of the device exceeds the first predetermined temperature level while requiring that the temperature of the device thereafter be reduced below a second predetermined temperature level before said electrical connection is re-established, said switching device including a non-conductive mounting means upon which are mounted a movable contact means and a bistable snap contact means, said first and second electrical connectors being connected electrically thereto, respectively, a thermal responsive bimetal means mounted on said non-conductive mounting means on the side of said movable contact means opposite said bistable snap contact means and having mounted thereon an actuator means defining a cavity containing a quantity of uncured material and first and second actuators, said first actuator including an actuator element extending into said curable material and a spring means in contact with said actuator element biasing said actuator element into contact with said movable contact means, and said second actuator extending into said curable material and arranged to contact the side of said bistable snap contact means opposite said movable contact means, comprising the steps of:

placing said bistable snap contact means in a first snap position in which it is biased into electrical contact with said movable contact means, deflecting said movable contact means toward said bistable snap contact means sufficiently to cause said bistable snap contact means to snap into a second snap position in which it is biased out of electrical contact with said movable contact means, moving said bistable snap contact means towards said movable contact means until a spacing between said movable contact means and said bistable snap contact means is obtained which is related to the temperature differential between said first and second predetermined temperature levels, while maintaining said second actuator in contact with said bistable snap contact means with said second actuator extending into said curable material, heating said switching device to said first predetermined temperature level, causing said bimetal means to deflect toward said movable contact means, and curing said curable material such that the relative positions of said first and second actuators and said thermal responsive bimetal means are fixed.

7. The method of claim 6 in which said curable material is a thermal curing resin and said step of curing said curable material includes the step of maintaining said switching device at said first predetermined temperature level until said curable material is cured.

* * * * *